US006107584A

United States Patent [19]

Yoneyama

[11] Patent Number: 6,107,584

[45] Date of Patent: Aug. 22, 2000

[54] KEY SWITCH

[75] Inventor: Masayuki Yoneyama, Fujisawa, Japan

[73] Assignee: Minebea Co., Ltd., Nagano-ken, Japan

[21] Appl. No.: 09/453,567

[22] Filed: Dec. 3, 1999

[30] Foreign Application Priority Data

Aug. 27, 1999 [JP] Japan ..... 11-241345

[51] Int. Cl.[7] ..... H01N 13/70

[52] U.S. Cl. ..... 200/344

[58] Field of Search ..... 200/5 A, 517, 200/341, 344, 345; 400/472, 490, 491, 491.2, 495, 495.1, 496

[56] References Cited

U.S. PATENT DOCUMENTS

| | | | |
|---|---|---|---|
| 5,847,337 | 12/1998 | Chen | 200/5 A |
| 5,901,837 | 5/1999 | Aimi | 200/344 |
| 5,947,616 | 9/1999 | Liang | 400/491.2 |
| 6,011,227 | 1/2000 | Yoneyama | 200/344 |

FOREIGN PATENT DOCUMENTS

| | | | |
|---|---|---|---|
| 6-260053 | 9/1994 | Japan | H01H 13/20 |

*Primary Examiner*—Michael Friedhofer

*Attorney, Agent, or Firm*—Nath & Associates; Gary M. Nath; Harold L. Novick

[57] ABSTRACT

In a key switch, in which, between the holder (20) overlapped and fixed on the switch substrate (10) and the keycap (50), interposing the pantograph assembly (30) disposed in X-figured two movable members (31), 32 and the mounting plate (40) by pushing the rubber spring (11) of the switch substrate (10) with the keycap (50) for shrinking the rubber spring to close the movable contact, the holder (20) is formed with a supporting plate (22) made from a thin stainless steel and a U-figured resin made supporting frame (23) on the supporting frame (23) the clamping portion (26) to support one end hinge pin (35) of the one movable member (31) and the sliding stepped portion (27) to support one end sliding hinge pin (36) of the other movable member (32) are formed and the supporting frame (23) is clamped between the raised pieces (24) provided on the periphery of the opening (21) of the supporting plate (22) and the switch substrate (10).

4 Claims, 3 Drawing Sheets

KEY SWITCH

BACKGROUND OF THE INVENTION

1. Field of the Invention

This invention relates to switch for keyboard input device, in particular, for a switch suitable for keyboard input device for a portable personal computer such as a note book and mobile type.

2. Related Art

Recently, a demand for miniaturization in thickness of a keyboard input device of a portable personal computer has been more increased, and in response to that demand, for example, in Japanese patent laid-open No. Hei 6-260053, such a keyboard as shown in FIG. 4 is proposed. This is formed by overlapping and fixing a plate-like holder 2 on a flexible circuit board (switch substrate) 1 comprising movable contact and a keycap 4 (hereinafter referred to as "keycap") is provided on a pantograph assembly (guide support member) 3.

The above pantograph assembly 3 comprises two hinge members (movable members) 6, 7, intermediate portions of which are connected in a hinge like so as to form a x figure, and both movable members 6, 7 are at one end thereof supported respectively on a holder 2 and clamping portions 2*a*, 4*a* provided on the keycap 4 rotatively, and each other end thereof is supported slidably on sliding stepped portions 4*b*, 2*b* provided on the keycap 4 and the holder 2. The keycap 4 is, by receiving a biasing force of a rubber spring 7 surrounding the movable contact through the pantograph assembly 3, normally positioned in an upper elevated position shown in figure, and when the keycap 4 is pushed from this state, the pantograph assembly 3 is folded and the rubber spring 7 is pushed to crush, so that said movable contact is adapted to close. That is, by interposing a pantograph assembly 3 between the holder 2 and the keycap 4, the settling height of the keycap 4 can be made as lower as possible, to that extent, the miniaturization in thickness of the input device for the keyboard can be realized.

By the way, the above key switch including not only the holder 2, but also the keycap 4 and the movable members 6 and 7 have been molded with a resin since the production cost is low and the preferable sliding feeling between the holder 2, the keycap 4 and the pantograph assembly 3 is guaranteed. In this case, since there is a limit of miniaturization in thickness in particular concerning the holder 2 (1 mm is a limitation thereof) due to the strength property or the material conditions at the time of molding, if the clamping portion 2*a* and the sliding and guiding portion 2*b* are included, the holder 2 becomes thick as a whole, and as a result, the demand for further miniaturization in thickness can not be responded.

Now, by preparing the holder 2 with a metal it is possible to miniaturize it in thickness, but in that case, due to the metal contact of the two movable members 6, 7 of the pantograph assembly 3 to the holder 2, the sliding feeling property is deteriorated, in addition, it must be necessary to prepare a complicated working to form the clamping portion 2*a* and the sliding and guiding portion 2*b*, which causes a production cost to become greatly high and that causes not to reach to a fundamental solution.

The present invention has been made in the light of the above problem, and the purpose thereof is to attain the miniaturization in thickness of the holder without deteriorating the property of the sliding feeling or inviting a great increase in production cost, and thereby to provide a key switch to greatly contribute in miniaturization in thickness of the keyboard input device.

SUMMARY OF THE INVENTION

In order to attain the above purpose, the present invention is characterized in that, in a key switch wherein a plate-like holder is overlapped and fixed on a switch substrate having a movable contact, a keycap is mounted on an upper portion of a pantograph assembly the lower part of which is pivoted on the holder, normally the keycap is made to be floated due to a biasing force of a rubber spring which is projected from an opening of the holder and surrounds the movable contact, in accordance with pushing in of the keycap the movable contact closes, the holder is formed with a metal supporting plate having the opening and a resin made supporting frame disposed and fixed along with the opening circumference, on the supporting frame the lower portion of the pantograph assembly is made to pivot and the pantograph assembly and the keycap are formed from a resin.

In thus formed key switch, since the holder is formed from the metal made supporting plate and the resin made supporting frame which pivots the lower portion of the pantograph, it becomes possible to use what is thin as the supporting plate and that becomes possible to miniaturize the holder comparing with the case where the whole body is formed with a resin. Further, the supporting frame, pantograph assembly and keycap are made from a resin, a good sliding feeling is secured between the holder, keycap and the pantograph.

The above supporting frame can be, in the present invention, made to form in such a constitution as it is clamped between a raised piece to be molded in a unitary manner with the opening circumference of the supporting plate and the switch substrate. The supporting frame also can be constituted in such a manner as it comprises a clamping portion to engage with a lower end portion of one of the movable member of the pantograph assembly disposed in X-letter shape and a sliding stepped portion to engage with a lower end of t h e other movable member, and said clamping portion and the sliding stepped portion constitute respectively in association with the switch substrate a bearing portion to support the lower end portion of the one movable member rotatively and a slide-guiding groove to support the lower end of the other movable member slidably.

The present invention does not limit the material of the above support plate, but it is preferable to use a thin plate of a stainless steel having a superior property of strength and anti-corrosion.

EMBODIMENT

Hereinafter, one embodiment of the present invention is explained referring to the attached drawings.

Figure 1:
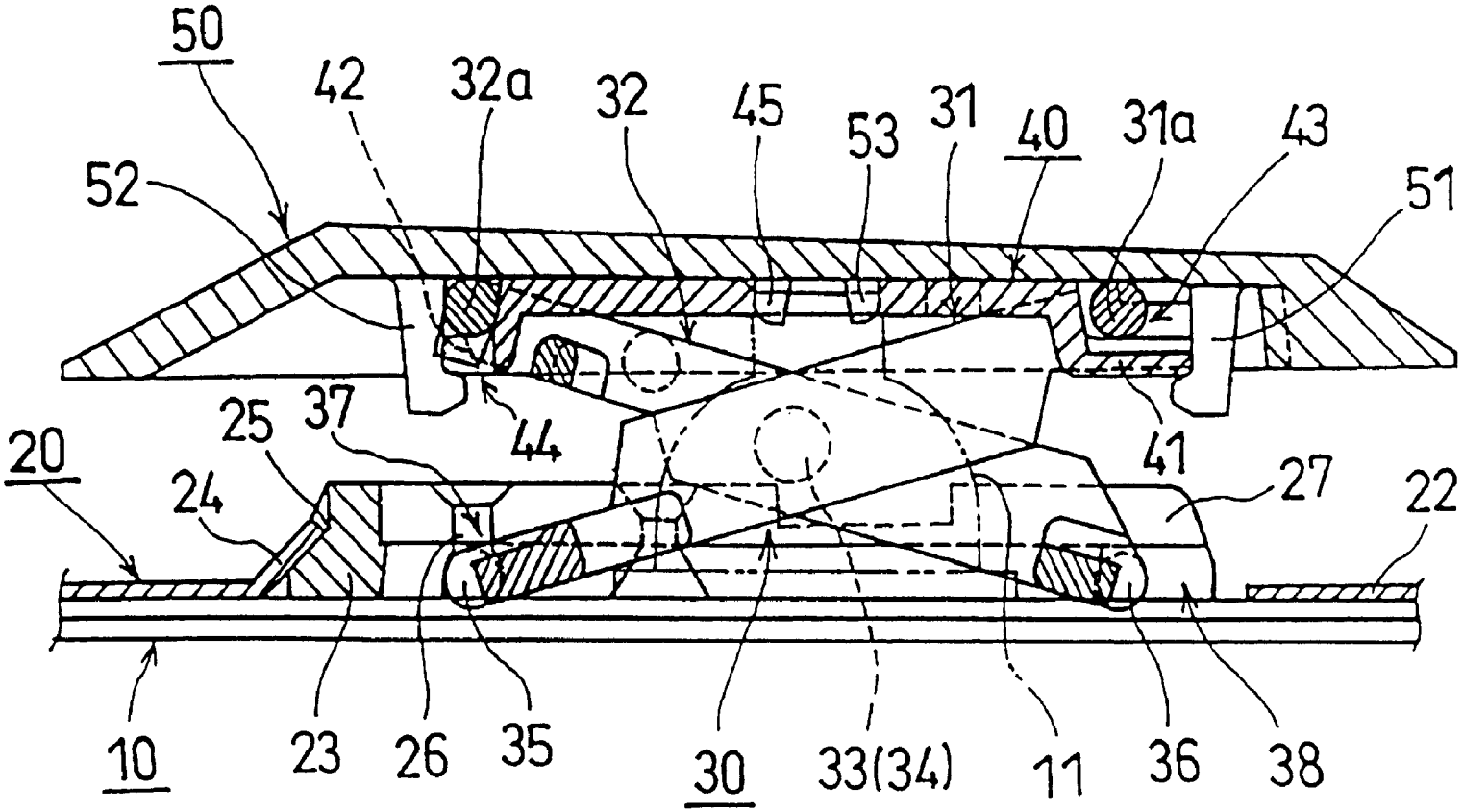
FIG. 1 is a sectional view showing the structure of the key switch of the present invention.
Figure 2:
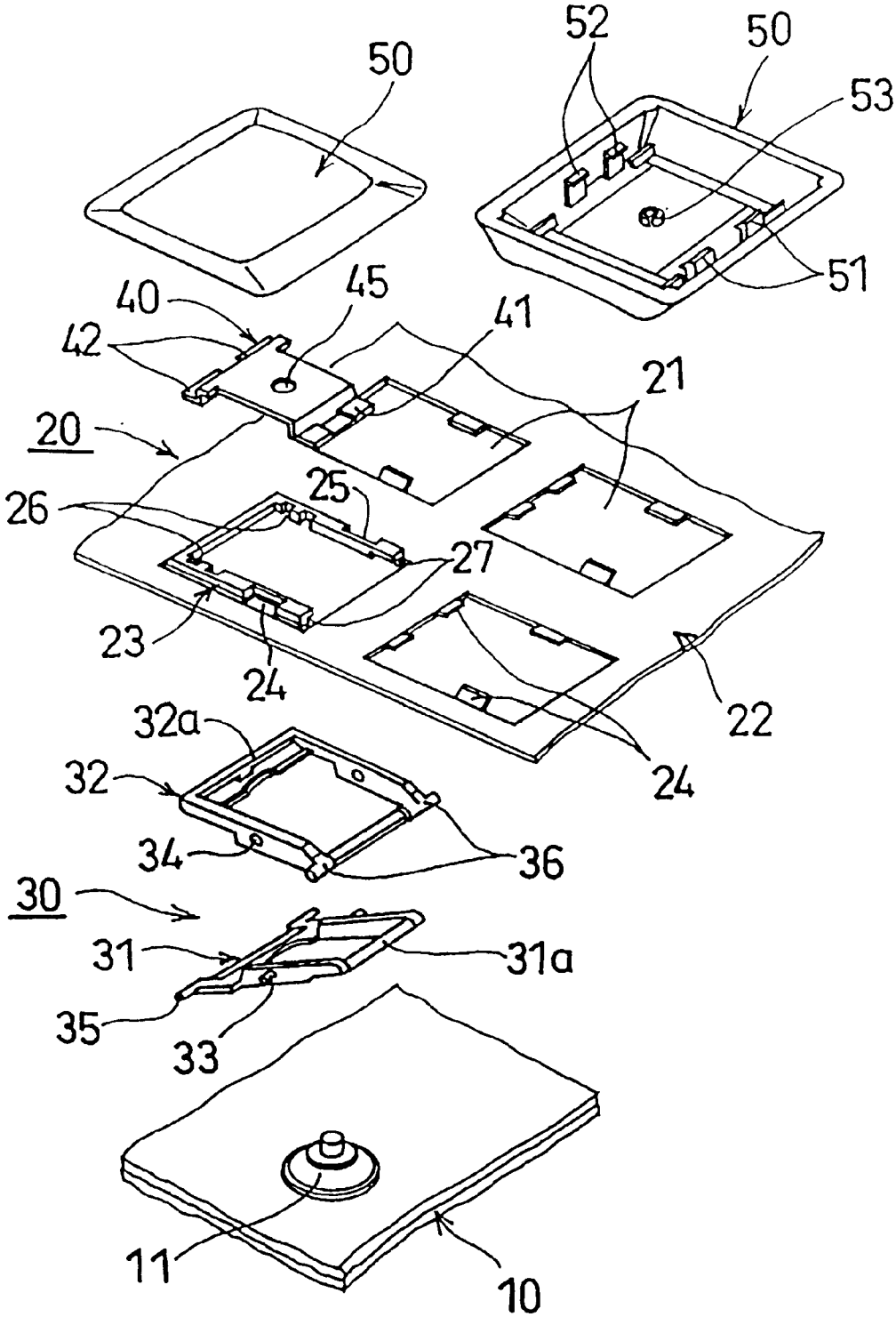
FIG. 2 is a broken and perspective view showing the key switch of the present invention.
Figure 3:
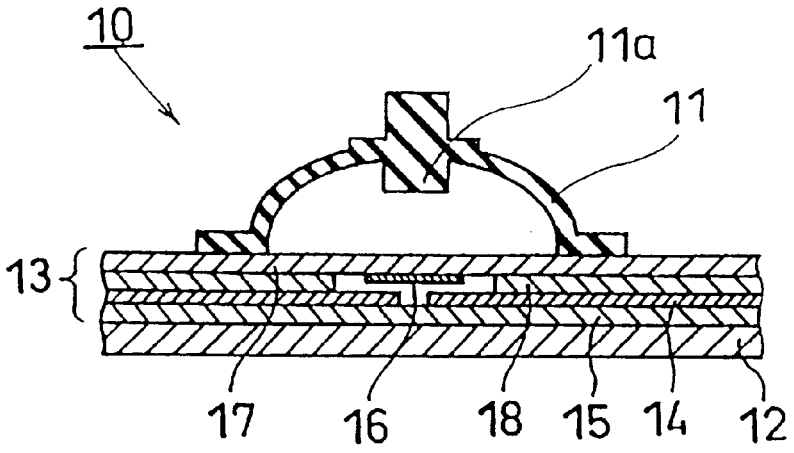
FIG. 3 is a sectional view showing the structure of the switch substrate constituting the key switch of the present invention.
Figure 4:
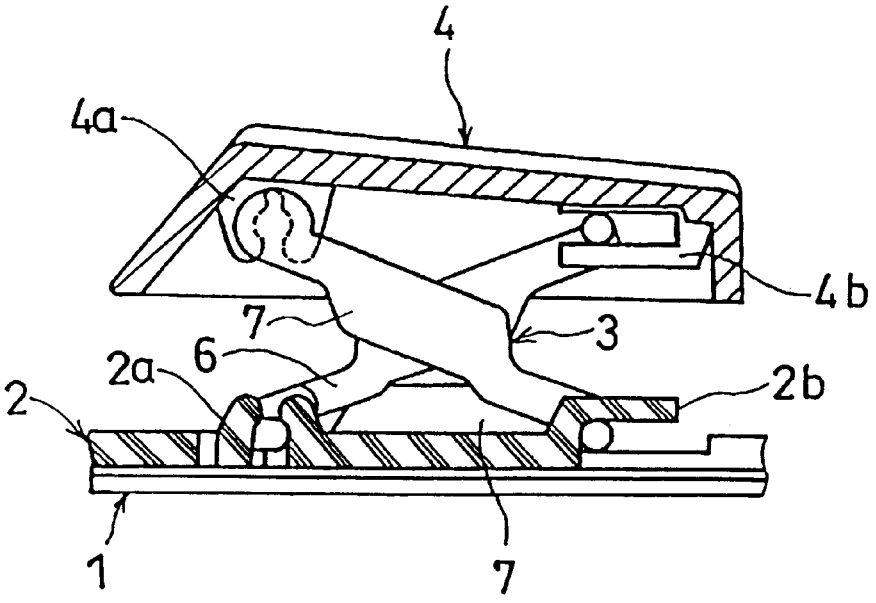
Fig. 4 Prior Art
FIG. 4 is a sectional view showing a structure of a conventional key switch.

FIGS. 1 to 3 show one embodiment of a key switch of the present invention. The key switch of the present invention comprises a switch substrate 10 having a plurality of rubber springs 11 surrounding later described movable contacts (FIG. 3), a plate-like holder 20 overlapped on and fixed to the switch substrate 10 and having a rectangular opening 21 for the rubber spring 11 to come through, a pantograph assembly 30, a lower portion of which is pivoted to the holder 20 and a keycap 50 mounted on the upper portion of the pantograph assembly 30 through a mounting plate 40.

The switch substrate 10, as shown in FIG. 3, is formed by disposing a membrane sheet 13 on metal (normally aluminum) plate 12. The membrane sheet 13 is formed from an insulating contact substrate 15 applied with a circuit wiring thereon, an insulating movable plate 17 formed with a movable conductive member 16 on the rear side and an insulating spacer 18 which separates said contact substrate 15 and the movable plate 17 with a tiny gap, and the rubber spring 11 is disposed at the position surrounding the rear side of the movable conductive member 16. The rubber spring 11 keeps normally a dome-like shape shown, in this state, the movable electric conductive member 16 keeps separated from the circuit wiring 14 to maintain the closing state of the movable contact. And, when the rubber spring 11 is pushed to crush, a projection 11*a* which is inside the top portion may push down the movable plate 17 to make the movable conductive member 16 contacted to the circuit wiring 14 to form the movable contact closed. For reference when pushing force to the rubber spring 11 is released, it will return to previous state shown due to the recovering force.

The holder 20 comprises a plane supporting plate 22 having the opening 21 and a U-shaped supporting frame 23 disposed in the opening 21 of the supporting plate 22. The supporting plate 22 is, here, formed with a stainless steel quite thin (approximately 0.2 mm), and around the circumference of the opening 21, a plurality of raised pieces 24 are formed in a unitary manner directing upward and toward the center of the opening 21. While, the supporting frame 23 is formed with a resin in a unitary manner, on its outer circumference, a plurality of coupling grooves 25 with which the raised pieces are coupled are formed. And, the supporting frame 23 are, by being coupled with the raised pieces 24, positioned in the opening 21 to and fro, and left and right, and clamped between the raised pieces 24 and the switch substrate 10. The supporting frame 23 is formed with a pair of clamping portion 26 to support the lower portion of the pantograph assembly 30 later explained in detail and a pair of stepped portion 27 for sliding.

The pantograph assembly 30 is formed by two frame shaped movable members molded with a resin in a unitary manner in such a manner as it forms a X figure shape in a hinged connection. In more details, on frame pieces of one movable member 31(a first movable member) disposing left and right, hinge pins 33 are provided, and on the other movable member 32 (a second movable member) disposing left and right, pin holes 34 in which the hinge pin 33 is coupled are provided respectively. Further, the most part of the first movable member 31 is formed narrower than the spacing between the left and right frame pieces of the second movable member 32, and in a state where the first movable member 31 is made to be positioned inside the second movable member 32, by bending mutually and flexibly both movable members, the hinge pins 33 are coupled with the pin holes 34, so that the first movable member 31 and the second movable member 32 are connected mutually rotatively.

The proximal portion of the first movable member 31 forming the pantograph assembly 30 is formed large in its width, and at both corners of the proximal portion, a second hinge pins 35 are projected which are able to engage with a clamp portion 26 of the supporting frame 23 forming the holder 20. The clamp portion 26 is formed from a different figured groove widened in its supporting frame 23 side, and by displacing the first movable member 31 upward from the rear side of the supporting frame 23, the second hinge pin 35 is engaged with the clamp portion 26. On the other hand, the second movable member 32 constituting the pantograph assembly 30, at the corner of the left and right end thereof, is provided with sliding pins 36 projected which are possible to engage with the sliding stepped portions 27. This sliding pins 36 is engaged with the above sliding stepped portion 27 by displacing the second movable member 32 upward from the rear side of the supporting frame 23. Thus, in the final state of assembly, the rear sides of these clamp portion 26 and the sliding stepped portion 27 are adapted to be closed due to the switch substrate 10, thereby between the clamp portion 26 and the switch substrate 10, the bearing portion 37 to pivot rotatively the second hinge pin 35 of the proximal end side of the first movable member 31 is formed in association. On the other hand, between the sliding stepped portion 27 and the switch substrate 10, a sliding and guiding groove 38 to guide the sliding pin 36 of the second movable member 32 is formed in association.

The mounting plate 40 is provided with supporting portions 41, 42 which are formed in stepped portions hanging from both ends of the mounting plate. Of these supporting portions, the supporting portion 41 of one end side has a function to support a frame piece (shaft piece) 31*a* of distal end of the first movable member 31 and the supporting portion 42 of the other end side has a function to support a frame piece (shaft piece) 32*a* respectively, and although the supporting portion 41 of one end side has a given length, the supporting portion 42 of the other side has a minimum length sufficient for supporting the shaft piece 32*a*. On the other hand, on the rear side of the keycap 50, hooks 51, 52 which are able to engage with the supporting portions 41, 42 of the mounting plate 40 are projected. The keycap 50 is connected removably to the mounting plate 40 by hooking the supporting portions 41, 42 of the mounting plate 40 on the hooks 51, 52 of both ends thereof. Thus, in this connecting state, between the supporting portion 41 of the one end side of the mounting plate 40 and the keycap 50, the sliding and guiding groove 43 to guide by sliding shaft piece 31*a* of distal end of the movable member 31 is formed in association with each other, on the other hand, between the supporting portion 42 of the other end of the mounting plate 40 and the keycap 50 the shaft piece 32*a* of the second movable member 32 a bearing portion 44 to support rotatively the shaft piece 32*a* of the second movable member 32 is formed in association with each other. Now, the mounting plate 40 and the keycap 50 are molded with a resin in a unitary manner respectively, and both is adapted to be positioned by engaging a split pin 53 projected on the rear side of the keycap 50 for positioning with a positioning hole 45 provided on the center of the mounting plate 40 to be positioned each other.

To assemble the above key switch, first, connecting the first movable member 31 and the second movable member 32 in a unitary manner by making use of the hinge pins 33 and the pin holes 34 provided on the first movable member 31 and the second movable member 32 respectively to obtain a pantograph assembly 30. Next, putting the shaft piece 31*a* of the first movable member 31 on the supporting portion 41 of the mounting plate 40, and while bending the shaft piece 32*a* of the movable member 32, hooking it on the other end supporting portion 42 of the mounting plate 40 to obtain a sub-assembly body of the pantograph assembly 30 and the mounting plate 40. On the other hand, as to the holder 20, while coupling the coupling groove 25 of the supporting frame 23 with keeping it to a given height by letting the supporting plate 22 front side rear, and while coupling the coupling groove 25 of the supporting frame 23 with the raised pieces 24, stay the supporting frame 23 putting on the raised pieces 24. Under that state, pushing in the sub-assembly body of the pantograph assembly 30 and the mounting plate 40 through the opening 21 of the holder 20. Then, the second hinge pin 35 of the first movable member 31 constituting the pantograph assembly 30 hooks the clamp portion 26 of the supporting frame 23 and the sliding pin 36 of the second movable member 32 hooks the sliding stepped portion 27 of the support frame 23.

Thereafter, while projecting the rubber spring 11 from the opening 21 of the holder 20, the switch substrate 10 is overlapped and fixed to the supporting plate 22 of the holder 20. Then, between the supporting frame 23 and the switch substrate 10 the bearing portion 37 and the sliding and guiding portion 38 are formed in association with each other, to the bearing portion 37 the lower portion (the second hinge pin 35) is supported rotatively, and to the sliding and guiding portion 38 the lower portion (the sliding pin 36) of the second movable member 32 is supported slidably. And at the same time, the biasing force of the rubber spring 11 is applied to the mounting plate 40, the pantograph assembly 30 extends to make a state where the mounting plate 40 is floated from the holder 20. At this state, when making the holder 20 turned back and while mating the positions of the split pin 53 and the mounting plate, pushing the keycap 50 from the upper in the mounting plate 40, the tip end portions of the supporting portion 41, 42 of the mounting plate 40 hook the hooks 51, 52 of the keycap 50, and the keycap 50 is made in a unit with the mounting plate 40. Thereby, between the mounting plate 40 and the keycap 50, the sliding and guiding portion 43 and the bearing portions 44 are formed in association with each other, to the sliding and guiding portion 43 the upper end portion (shaft piece 31*a*) is supported slidably, on the bearing portion 44 the upper end portion (shaft piece 32*a*) is supported rotatively, and thus the key switch is completed.

Since, in this key switch of the present invention, the holder 20 is formed from the metal made supporting plate 22 and the resin made supporting frame 23 to support the lower portion of the pantograph assembly 30, it is possible to employ a thin type of supporting plate 22 to enable the holder 20 to miniaturize in thickness comparing the case of molding the whole in a unit. In addition, since the supporting plate 22 is configured from a simple plane plate-like, the production cost increasing is held to be a little.

In the embodiment of the present invention, the supporting frame 23 is constituted in such a manner as it is clamped between a plurality of raised pieces 24 provided on the circumference of the opening 21 of the supporting plate 22 in the opening and the switch substrate 10, the assembling process of the supporting frame 23 becomes quite simple. Further, the supporting frame 23 is constituted in such a manner as it comprises the clamping portion 25 to support the lower end portion of one movable member 31 of the X-figured pantograph assembly 30 and the sliding stepped portion 26 to support slidably the lower portion of another movable member 32, merely by displacing the pantograph assembly 30 in one direction through the opening 21 of the holder 20, the lower portion of the pantograph assembly 30 can engage with the supporting frame 23, thereby the assembly of the pantograph assembly 30 becomes simple. Further, since the keycap 50 is constituted in such a manner as it is mounted removably on the upper portion of the pantograph assembly 30 through the mounting plate 40, the assembling of the key switch of the present invention becomes simple as a whole.

In thus completed key switch, when the keycap 50 is pushed in, not only the first and second movable members 31, 32 forming the pantograph assembly 30 swing around the bearing portions 37, 44 as fulcrum but also respective end portion slides along the sliding and guiding portions 43, 38, and the pantograph assembly is folded to the rubber spring 11 is pushed to crush, thereby the movable contact in the switch substrate 10 is closed. On the other hand, from this state, when releasing the pushing force toward the keycap 50, due to the restoring force of the rubber spring 11, the first and second movable members 31, 32 may again swing around the bearing portions 37, 44 as fulcrum and respective one end of the slides along the sliding and guiding portions 43, 38, the pantograph assembly extends, the keycap 50 returns to the previous state to open the movable contact in the switch substrate 10. Thus, since not only the supporting frame 23 to hold the holder 20 for supplying the sliding and guiding portions 43, 38, but also the first and second movable members 31, 32 forming the pantograph assembly 30, the mounting plate 40 and keycap 50 are made of a resin, a preferable sliding feeling between the pantograph assembly 30 and the holder 20 and the keycap 50 is secured.

Here, since the keyboard inputting device is installed with many key switches, in assembling these to the keyboard, for instance, the following processes are employed.

That is, first preparing a tray (not shown) having placing portions of necessary number of keycaps 50 and the keycaps are placed on each of them upside down. Subsequently, on these trays the supporting plate 22 constituting the holder 20 is covered upside down, within the opening 21 of the supporting plate 22 the hooks 51, 52 of the keycap 50 are positioned, then each of the supporting frame 23 is accommodated in the opening 21 of the supporting plate 22 and which is put on the raised pieces 24 of the supporting plate 22. On the other hand, a sub-assembly body which is formed by uniting the pantograph assembly 30 and the mounting plate 40 is prepared, and each of the sub-assembly bodies is pushed in the above opening 21 following the mounting plate 40, with the bearing portions 41, 42 the hooks 51, 52 are engaged to unite the keycap 50 to the sub-assembly. Then, with the clamping portion 25 of the supporting frame 23 and the sliding stepped portion 26, the hinge pin 35 of the first movable member 31 of the pantograph assembly 30 and the sliding pin 36 of the second movable member 32 are engaged respectively. Then, the switch substrate 10 is mating with the supporting plate 22 while pushing in the rubber spring 11 in the opening 21, and the switch substrate 10 is united to the supporting plate 22, by this the assembling process of each key switch to the keyboard inputting device is completed.

Thus finished keyboard inputting device, since the holder 20 is miniaturized in thickness due to the use of metal supporting plate 22, as a whole, it becomes thinner, which is suitable for use of a portable type of personal computer such as a note book type or mobile type of personal computer. In addition, since a membrane sheet 13 is clamped like a sandwich by the metal made plane plate 12 on its back side and the metal made supporting plate 22 on its front surface side, a ground surface is doubled, and an electro-static damage (ESD) is sufficiently prevented to increase the reliability.

As explained above, according to the key switch of the present invention, without sacrificing the sliding feeling or inviting an increasing of production cost, the miniaturization in thickness of the holder can be attained, which contributes greatly in miniaturization in thickness of the keyboard inputting device.

What is claimed is:

1. In a key switch which is formed by a plate-like holder overlapping and fixed on a switch substrate having a movable contact, a keycap mounted on an upper portion of a pantograph assembly, a lower portion of the pantrograph assembly is supported by the holder and a rubber spring projects from an opening of the holder for surrounding the movable contact, wherein the keycap is usually made to float by a biasing force of the rubber spring and by pushing down of the keycap the movable contact is closed, the key switch is characterized in that the holder is formed with a metal made supporting plate having the opening and a resin made supporting frame disposed and fixed along the opening of the supporting plate, the supporting frame is made to support the lower portion of the pantograph assembly, and the pantograph assembly and the keycap are made from a resin.

2. A key switch according to claim 1, wherein the supporting frame is clamped between a raised piece formed along the circumference of the opening of the supporting plate and the switch substrate.

3. A key switch according to claim 2, wherein the supporting frame comprises a clamping portion to hook the lower portion of one movable member of the pantograph assembly and a sliding stepped portion to hook the other movable member of the pantrograph assembly, the clamping portion and the sliding stepped portion form a sliding and guiding groove, in association with the switch substrate respectively, in such a manner that the clamped portion forms a bearing to support the lower portion of the one movable member rotatively and the sliding stepped portion supports the lower portion of the other movable member slidably.

4. A key switch according to one of claims 1 to 3, wherein the supporting plate is formed from a thin stainless steel.

* * * * *

UNITED STATES PATENT AND TRADEMARK OFFICE

CERTIFICATE OF CORRECTION

PATENT NO. : 6,107,584
DATED : August 22, 2000
INVENTOR(S) : Masayuki Yoneyama

It is certified that error appears in the above-identified patent and that said Letters Patent is hereby corrected as shown below:

Column 8,
Line 18, change "one of Claims 1 to 3" -- Claim 1 --.
Line 20, please add claim 5 and 6 as follows:

-- 5. A key switch according to Claim 2, wherein the supporting plate is formed from a thin stainless steel. --

-- 6. A key switch according to Claim 3, wherein the supporting plate is formed from a thin stainless steel. --

Signed and Sealed this

Twenty-third Day of July, 2002

*Attest:*

*Attesting Officer*

JAMES E. ROGAN
*Director of the United States Patent and Trademark Office*